US005410876A

United States Patent [19]

Simko

[11] Patent Number: 5,410,876

[45] Date of Patent: May 2, 1995

[54] CATALYTIC CONVERTER ASSEMBLY WITH BYPASS

[75] Inventor: Aladar O. Simko, Dearborn Heights, Mich.

[73] Assignee: Ford Motor Company, Dearborn, Mich.

[21] Appl. No.: 123,123

[22] Filed: Sep. 17, 1993

[51] Int. Cl.[6] ..... F01N 3/20

[52] U.S. Cl. ..... 60/288; 60/324

[58] Field of Search ..... 60/274, 288, 324

[56] References Cited

U.S. PATENT DOCUMENTS 3,751,917 8/1973 Garcea ..... 60/288
4,538,412 9/1985 Oishi ..... 60/288
4,969,328 11/1990 Kammel ..... 60/288
5,143,701 9/1992 Schatz ..... 60/301

*Primary Examiner*—Ira S. Lazarus
*Assistant Examiner*—Daniel J. O'Connor
*Attorney, Agent, or Firm*—Jerome R. Drouillard; Roger L. May

[57] ABSTRACT

A very compact arrangement of a catalyst bed and exhaust gas bypass passage for a catalytic converter assembly having an essentially overall oval shape with the catalyst bed and bypass passage essentially parallel and side-by-side, and a multi-wing butterfly valve alternately seatable to close one of the passages while opening the other, and vice-versa.

13 Claims, 4 Drawing Sheets

CATALYTIC CONVERTER ASSEMBLY WITH BYPASS

FIELD OF THE INVENTION

This invention relates in general to an automotive type exhaust system. More particularly, it relates to a compact catalytic converter assembly in which a catalyst bed is uniquely packaged with an exhaust gas bypass passage, with the exhaust gas flow controlled by a selectively operable bypass valve.

BACKGROUND OF THE INVENTION

Close coupled catalysts (CCC) significantly improve emission control in cold start and during warmup. Under heavy load operation, however, they can reach temperatures that can affect the durability of the catalyst. Therefore, it is desirable to bypass the CCC under heavy loads or preferably at all times except in cold start and warm-up. The packagability of such a device, however, is very difficult. The purpose of this invention is to provide the most compact arrangement of a catalyst and a valve-controlled bypass passage.

DESCRIPTION OF THE PRIOR ART

Assemblies of catalyst beds with valve controlled exhaust gas bypass passages are known in the prior art.

U.S. Pat. No. 3201206, Wawrziniok, shows and describes a muffler with an inner exhaust cleaner 2 divided into two chambers 6 and 3 by a perforated plate, 61. A curved gas inlet flow conduit 5 directs flow into chamber 6, where temperature responsive shunt valves 4, 4A are located. With the valves closed, gas is directed into chamber 6, then through catalyst 3, and out into muffler space 7 and outlet 8. With the valves open, gas flows from chamber 6 directly into muffler space 7 and outlet 8. The assembly is large, the valves when open do not block flow of exhaust gas through the catalyst, and the gases must pass into the chamber 6 before they are in contact with the valves.

U.S. Pat. No. 3201933, Baden shows and describes an afterburner (catalyst) system having a combustion chamber 22 that can receive exhaust gases from a pipe 69 through inlets 39,41 for oxidizing and burning unburned CO, HC, and H. The chamber has heat exchangers 23,24 and is surrounded by an insulating jacket 74 (FIG. 8) containing asbestos. Conduit 27 is connected to atmosphere. A two position butterfly valve 46 alternately diverts the gases to conduit 26,27 and to atmosphere, or to afterburner 20.

SUMMARY OF THE INVENTION

The invention provides a construction of a catalytic converter in which a catalyst is combined with a valve-controlled exhaust gas bypass passage in a manner providing the most compact arrangement possible thereby maximizing the ease of packagability of the assembly. The overall assembly is adapted to be aligned with and inserted between aligned sections of a vehicle exhaust pipe. It has an essentially oval overall shape, for compactness, with a dual wing butterfly valve moveable alternately to direct exhaust gases through the catalyst while blocking the bypass passage, or straight through the bypass passage to the exhaust pipe while blocking the passage to the catalyst bed.

In one embodiment, the passage to the catalyst projects out at right angles to the main flow path and to the bypass passage, and is reduced in cross-section to reduce restriction to flow. In a second embodiment, blockage means extends from the valve in a manner to close the catalyst passage while reducing flow restriction. In other embodiments, a large fraction of the oval cross-section is occupied by an essentially circular catalyst bed, the remaining cross section being fully utilized by an essentially semi-circular exhaust gas bypass passage, with a dead air gap between the two to insulate the catalyst from the hot exhaust gases in the bypass passage.

A further feature is a dual winged butterfly bypass valve that is loosely mounted on a shaft having a T-shaped bar that presses the valve wings at a single point near the center of the area to be closed off to fully seat the valve.

It is, therefore, a primary object of the invention to provide a catalytic converter assembly in which a close coupled catalyst is integrated with an exhaust gas bypass passage in as compact an arrangement as possible, and with a dual wing bypass control valve that uniquely closes the passages with leakproof seating against a flat machined surface of the assembly.

Other objects, features and advantages of the invention will become more apparent upon reference to the succeeding, detailed description thereof, and to the drawings illustrating the preferred embodiments thereof.

DESCRIPTION OF THE PREFERRED EMBODIMENTS

The emission control in start-up and during warmup of a spark ignition powered vehicle is improved by installing a catalyst very close to the engine exhaust valves. During sustained vehicle cruise condition, however, the close coupled catalyst (CCC) can overheat. This can be avoided if the catalyst is bypassed after the early part of warmup. The bypass valve should be compact to facilitate packaging and to minimize thermal inertia.

Figure 1C:
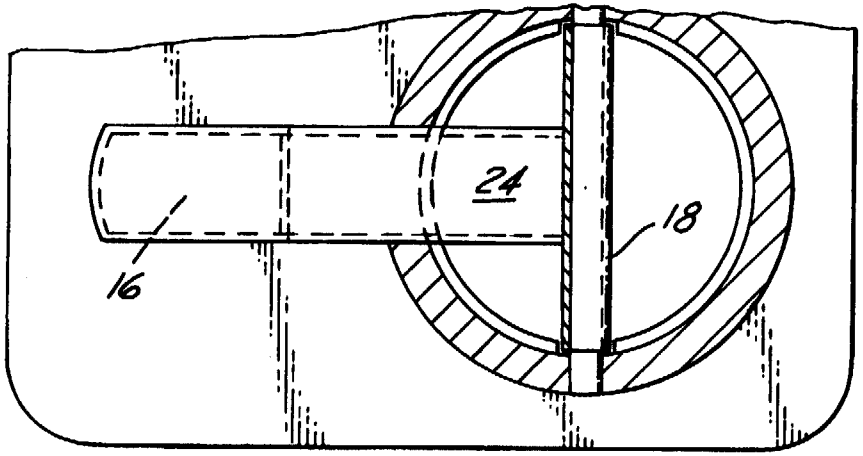
FIGS. 1B and 1C are cross-sectional views taken on planes indicated by and viewed in the direction of the arrows 1B—1B and 1C—1C of FIG. 1A.
Figure 1B:
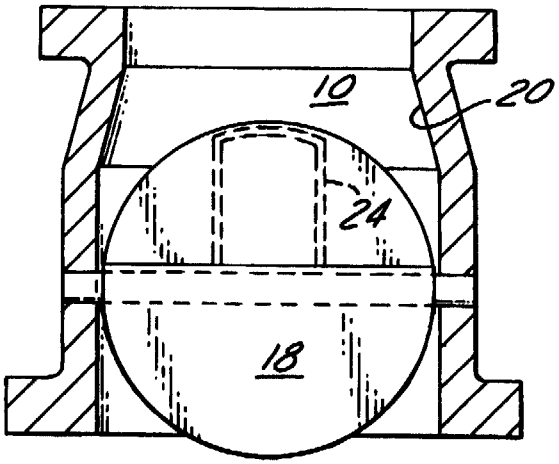
Figure 1A:
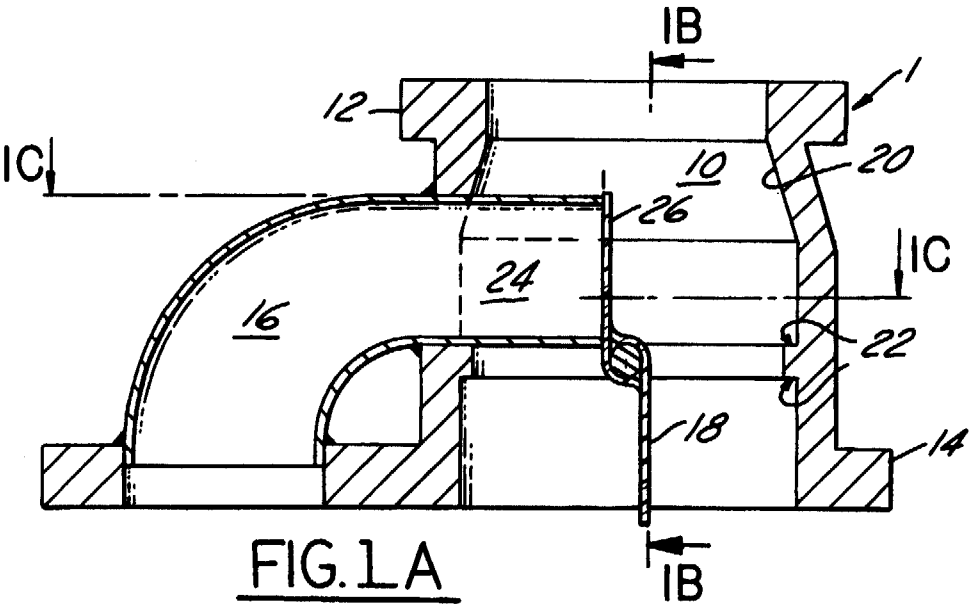
FIG. 1A is a cross-sectional view of a catalytic converter assembly embodying the invention.

FIGS. 1A–1C show a design wherein a single butterfly valve can alternately close the main exhaust (bypass) duct/tract or the CCC tract. The design takes advantage of the fact that the CCC tract can be much smaller in flow area than the main tract because the CCC tract conducts the exhaust gases only when the exhaust mass flow rate is no more than 25–30% of the maximum.

More specifically, FIG. 1A shows a catalytic converter assembly that shows a valve housing 1 that defines an open ended exhaust gas duct 10. The housing has flanges as shown at both the top 12 and bottom 14, as seen in the figure, that are adapted to be attached between aligned, separated portions of a conventional automotive type exhaust pipe. The exhaust gas can flow essentially straight through the duct in a bypass manner, or can be directed into a side CCC passage 16 leading to a catalyst bed, not shown, as controlled by a valve 18.

The inside diameter of the valve housing is enlarged by about 20%, as indicated at 20, to accommodate the large dual winged butterfly valve 18. The two halves of the valve are offset in order to facilitate sealing on the top and the bottom of a 2 mm., for example, wide lip 22 formed within the housing.

The inlet 24 to the CCC side passage 16 in this case has a small rectangular shape, as best seen in FIG. 1B, with, for example, 20×20 mm. dimensions that projects out into the main duct from the side. Passage 16 then is turned 90 degrees and increased in cross-sectional flow area to accommodate the larger entry cone of the catalyst, not shown.

The CCC tract can be formed from thin wall stainless steel, for example, and would be welded into the cast iron housing casting. As shown, the inlet 24 of the CCC tract 16 is located so as to be in contact with the upper wing 26 of the butterfly valve 18 when the latter is in the open or bypass position shown. In this position, the valve fully covers the entry or inlet 24 to the CCC tract thereby preventing the exhaust gases from flowing into this tract. Conversely, when the butterfly valve 18 is turned 90 degrees clockwise, the exhaust can only flow through the CCC tract 16.

The CCC tract would be designed to have a flow area of 25–33%, for example, of that of the main tract 10. FIG. 1C indicates that the entry portion 24 of the CCC tract reduces the flow area of the main tract. The purpose of the 20% enlargement of the main tract diameter is to compensate for this flow area reduction.

Figure 2B:
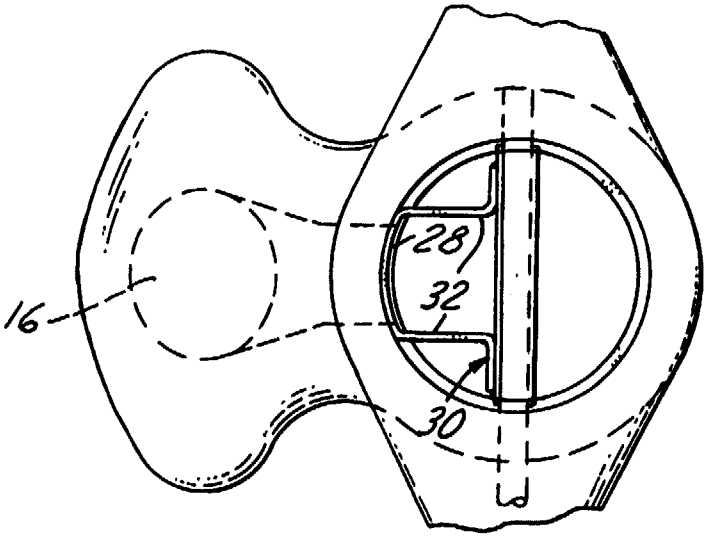
Figure 2A:
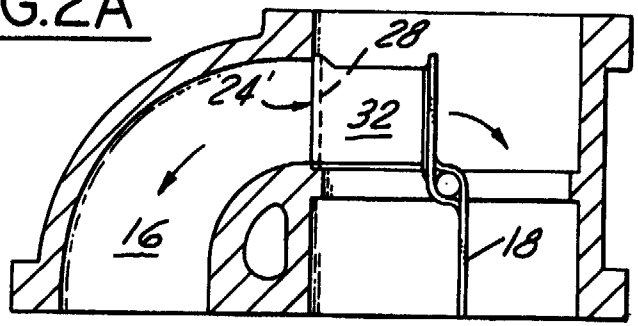

FIGS. 2A and 2B show a modified embodiment of FIG. 1. The inlet 24' to the CCC tract 16 in this case is rectangular but is flush to the side of the main housing. Closing of the CCC tract is effected by a sheet metal door 28 that lies in a plane parallel to but spaced from one wing of the valve. It conforms to the shape of the side wall of the housing. The door is part of a U shaped support 30 with side wings 32 that are welded to the upper half of the butterfly valve 18.

The U-shaped construction described forms the door so as to present minimal flow resistance to the exhaust flow when the main duct or tract is open, as seen in FIG. 2B. When the butterfly valve 18 is rotated clockwise to close the main tract while opening the CCC tract, the door 30 and side wings 32 rotate 90 degrees and form a further blockage to flow through the main duct.

The flow area of the CCC tract is about 26% of the area of the main tract 10, although design modifications within the scope of the invention would allow larger CCC tract areas of, say, 30–33%, for example, if it were necessary.

Figure 3B:
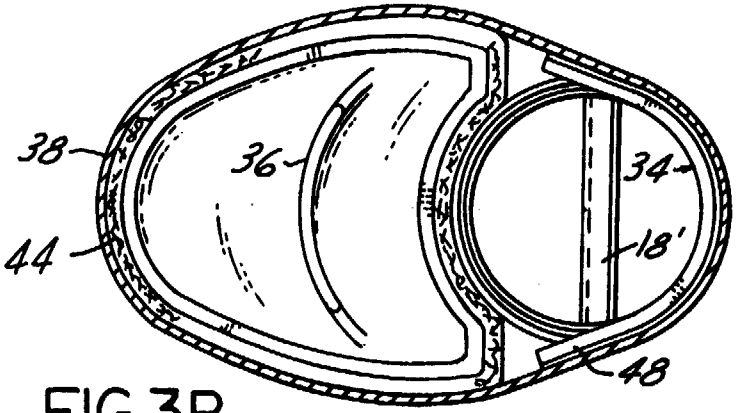
FIGS. 2A and 2B, 3A and 3B, and 4A and 4B, are cross-sectional views similar to and corresponding to the FIGS. 1A and 1C showings, illustrating other embodiments of the invention.
Figure 3A:
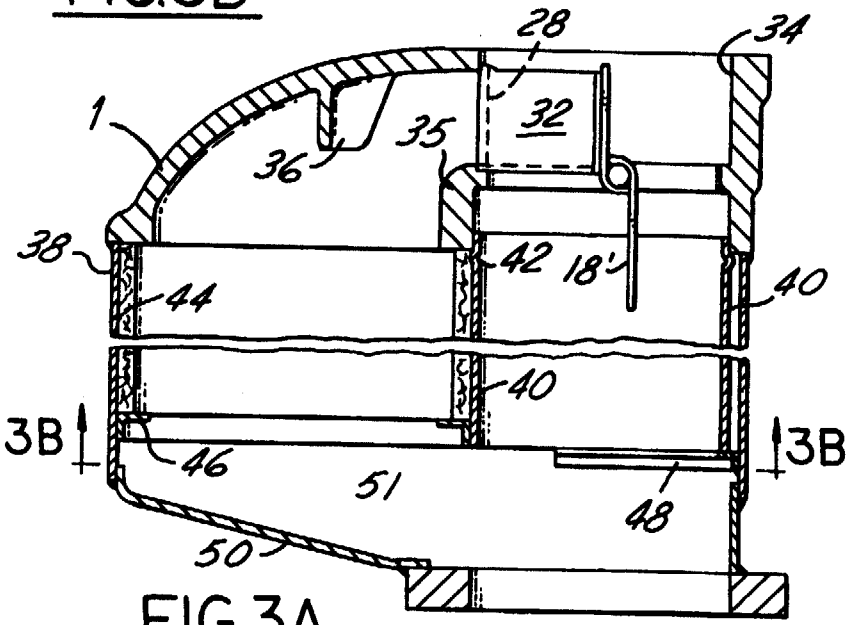

FIGS. 3A–3B illustrate a further embodiment of the invention in which the catalyst bed and bypass passage are closely integrated to be contiguous to provide as compact an assembly as possible. As best seen in FIGS. 3A and 3B, the housing or outer shell is oval shaped in cross-section, with a circular inlet 34 to the main duct or bypass passage occupying one portion of the oval. The inlet contains the same bypass valve 18' as in FIG. 2, with the U-shaped plate or door 28 for closing the CCC duct.

The CCC tract in the casting is formed so as to promote near equal distribution of the exhaust gases to the entire face of the catalyst. To achieve this, one or more diverter ribs 36 can be cast onto the roof of the CCC tract. The underside of the cast housing 1 is machined flat and an oval shaped catalyst container 38 is welded to it. A steel tube 40 is pressed into the housing to form the main tract that bypasses the catalyst. A rolled bead 42 on the tube limits its vertical position in the cast housing.

The CCC catalyst has a unique shape as shown to completely utilize the remaining cross-sectional area of the oval container, thereby occupying a major portion of the interior. It would be installed in a conventional manner, using a stainless steel mesh insulating jacket or blanket 44 around it. The catalyst would be held in place by a welded-in retainer 46. In order to protect the catalyst from overheating by the exhaust gases in the main bypass tract, the tube 40 could be constructed as a double wall tube with an air gap between the walls. This will be described in connection with the FIGS. 4A–4E showings.

The tube 40 is held in place at its lower end by another welded-in retainer 48. The container or housing 1 is closed by a welded-in cover 50 defining a discharge plenum 51, the cover being equipped with a flange as shown suitable for connection to the exhaust pipe downstream, not shown. It will be seen that there is very little wasted space within the three dimensional envelope of this assembly.

Figure 4C:
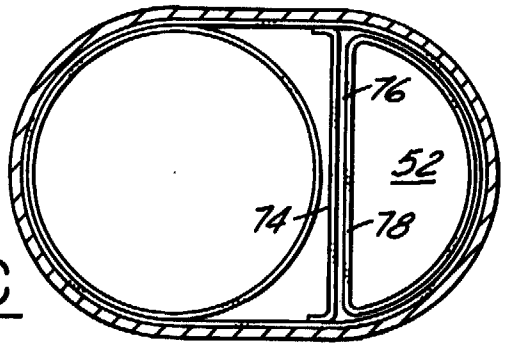
FIG. 4C is a cross-sectional view taken on a plane indicated by and viewed in the direction of the arrows 4C—4C of FIG. 4D.
Figure 4D:
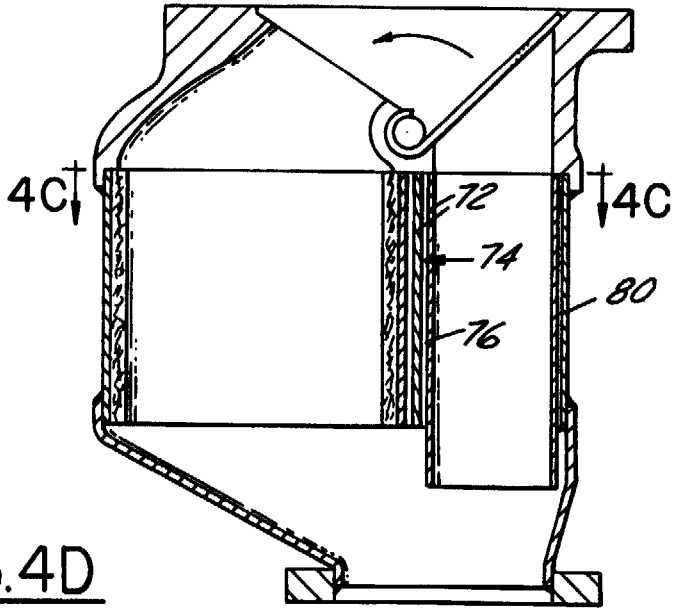
FIG. 4D is a cross-sectional view similar to FIG. 4A, illustrating a modification.
Figure 4B:
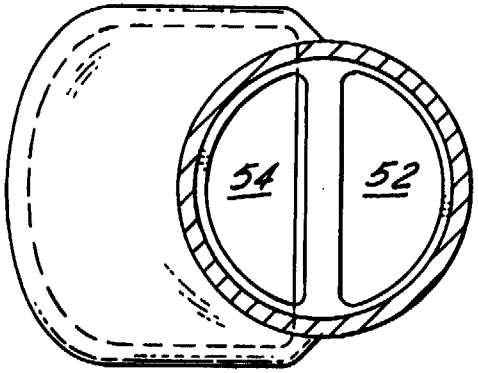
Figure 4A:
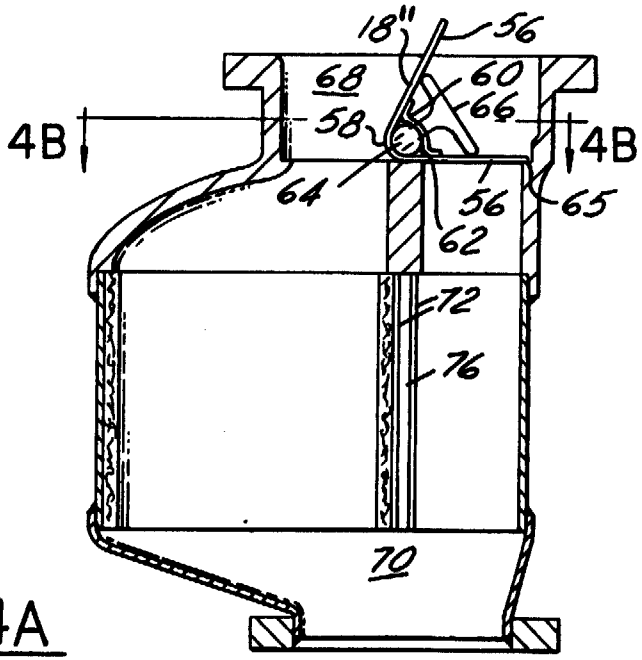

FIGS. 4A and 4D show a slightly different construction configured to be very compact in overall envelope while still accommodating a more unique upstream bypass valve to alternately close the main or CCC tract. Again, the overall envelope is oval, and a large fraction of the cross-section is occupied by a circular (FIG. 4C) close coupled catalyst. At the opposite end of the oval, the cast iron housing upper gas inlet portion is cast with two semicircular passages 52,54, one for the main bypass tract and the other for the laterally offset and parallel CCC tract.

The bypass valve 18" in this case is uniquely mounted to assure near leakproof seating when the valve is moved to close its respective tract. The valve is essentially a spread U-shape, with two arm portions 56 and a rounded base portion 58. A curved retainer member 60 forms a cylindrical cavity 62 for loosely receiving an actuating shaft 64. The cavity in the valve is about 1–1.5 mm, for example, larger than the shaft OD in order to facilitate full seating of the valve on flat machined surface 65 of the cast housing. To effect this seating, the shaft is equipped with a T-shaped bar 66 that presses the valve wings on a single point close to the center of the area to be closed off. A further advantage of this arrangement is the relative protection of the shaft and its bearings from the heat of the exhaust gases.

It will be seen that the oval shape very effectively utilizes the space available to provide a very compact structure, with the catalyst and bypass passage in side-by-side, parallel, contiguous relationship, and inlet and discharge plenums 68,70 connecting the exhaust gases from one part of the exhaust pipe to the other. A disadvantage of such a construction, however, is the heat flow from the main tract to the CCC when the CCC tract is closed, and the CCC, therefore, should be protected from overheating.

To reduce the heat transfer, the CCC and main duct are separated by a pair of welded-in dividers or partitions 72 defining a double wall construction 74, with a dead air space 76 between. This is shown more clearly in FIGS. 4C. To further enhance heat insulation, the flat wall 78 (FIG. 4C) that forms part of the main tract can be wrapped around the oval outer shell, effectively making the main tract a double walled construction for perhaps ⅔rds of its circumference, as referred to earlier. This wall can be spaced from the outer wall by dimpling, and then spot welded to the outer housing on a few points while still maintaining an air gap for a large fraction of its surface. Alternately, the entire main tract can be of double walled construction as it passes by the CCC, as best seen at 80 in FIG. 4D.

Figure 5B:
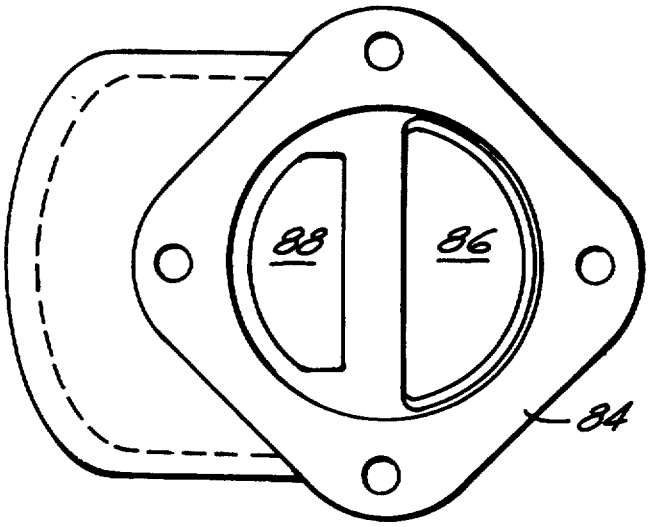
FIGS. 5A and 5B are cross-sectional views similar to FIGS. 4A and 4B illustrating a further modification.
Figure 5A:
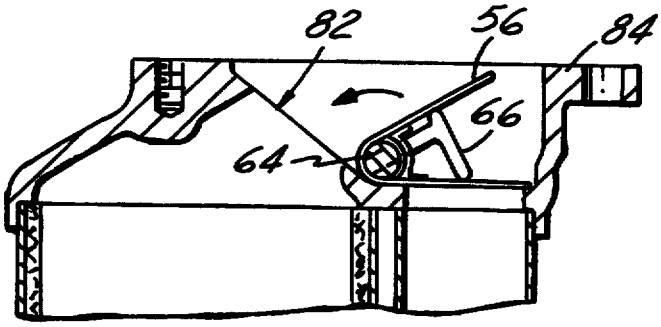

FIGS. 5A and 5B show a still further embodiment of the invention. In this case, the length of the assembly can be shortened by about 23 mm, for example, if the seating surface of the CCC tract is angled with respect to the longitudinal axis of the CCC, as shown at 82 in FIG. 5A. This geometry also causes the flow distribution across the face of the CCC to be better. As seen in FIG. 5B, the gas inlet flange 84 contains a circular opening with two semicircular inlets 86,88, the inlet 88 to the CCC duct being smaller because of its angulation.

From the foregoing, it will be seen that the invention provides a catalytic converter assembly with a compactness that enhances its packagability in the exhaust pipe of an automotive vehicle, by integrating a catalyst bed with a valve controlled gas bypass passage and insulating the catalyst from the heat of the exhaust gases as they pass through the bypass passage.

While the invention has been shown and described in its preferred embodiments, it will be clear to those skilled in the arts to which it pertains that many changes and modifications may be made thereto without departing from the scope of the invention.

I claim:

1. A compact catalytic converter assembly adapted to be inserted in alignment with and between portions of the exhaust pipe of an automotive type vehicle for receiving exhaust gases therefrom and redirecting exhaust gases thereto, including an outer hollow shell essentially oval in cross-section having an essentially circular exhaust gas inlet opening at one side, means dividing the opening into first and second exhaust gas tracts, first and second passages in parallel side-by-side relationship connected respectively to the tracts for the passage of exhaust gases therethrough, a discharge plenum connected to the opposite ends of the passages adapted to be connected to the exhaust pipe, the first passage containing a catalyst bed, the second passage constituting a bypass passage for passing the exhaust gases through the assembly bypassing the catalyst bed, selectively movable valve means in the inlet movable to positions alternately directing flow of exhaust gases through the first or second tract while blocking the other tract, and means to insulate the bed from the hot exhaust gases passing through the bypass passage including divider means between the passages providing a dead air gap therebetween.

2. An assembly as in claim 1, wherein the catalyst bed includes an essentially circular container of large cross-sectional area occupying a major portion of the oval shape of the shell, the bypass passage being essentially semi-circular in shape and filling the remaining area of the shell.

3. An assembly as in claim 1, including insulating means surrounding the container and spaced from the air gap by the divider means.

4. An assembly as in claim 1, including an essentially circular container of large cross-sectional area for the catalyst bed occupying a major portion of the oval shape of the shell, an essentially semi-circular tube occupying the remaining minor portion of the shell and defining the bypass passage, the divider means being spaced from the tube to provide the air gap therebetween.

5. An assembly as in claim 3, the insulating means including an insulating jacket surrounding the catalyst bed.

6. An assembly as in claim 1, wherein partition means divides the opening into exhaust gas inlets to the tracts of essentially equal cross-sectional areas, the first tract gradually increasing in cross-sectional area and being directed laterally of the longitudinal axis of the shell for connection to the large cross-sectional area of the catalyst bed container, the second tract and bypass passage remaining essentially aligned with the longitudinal axis of the exhaust pipe for the flow of exhaust gases essentially straight through minimizing the restriction to flow.

7. An assembly as in claim 1, wherein the inlet to the tract for the catalyst bed is of smaller cross-sectional area than that of the bypass passage tract and is angled with respect to the longitudinal axis of the shell to reduce the overall length of the assembly.

8. An assembly as in claim 4, the tube being a dual walled tube with an air gap between the walls, the outer wall constituting the divider means.

9. An assembly as in claim 1, the valve means including a shaft, a butterfly type valve rotatably mounted on the shaft, and actuating means on the shaft engageable with the valve for moving the latter upon rotation of the shaft.

10. An assembly as in claim 9, wherein the actuating means is an essentially T-shaped bar having a base secured to the shaft and a crossbar with the opposite edges of the crossbar engageable with the valve for moving the same.

11. An assembly as in claim 9, wherein the valve is essentially a U-shaped plate having arm portions connected by a base, the bar being positioned within and between the arm portions.

12. An assembly as in claim 11, wherein the edges of the crossbar engage and press against the arm portions of the plate essentially on a single point near the midpoint of the length of each arm portion.

13. An assembly as in claim 1, the valve means including a butterfly type valve and a shaft and means for loosely mounting the valve on the shaft with a limited lost motion type relative rotation therebetween providing a self centering seating of the valve against the inlet tracts.

* * * * *